US010982918B2

(12) United States Patent
Newberry et al.

(10) Patent No.: US 10,982,918 B2
(45) Date of Patent: Apr. 20, 2021

(54) FIREARM BUFFERS AS WELL AS METHODS OF ASSEMBLING SAME

(71) Applicant: Abrams Airborne Manufacturing, Inc., Tucson, AZ (US)

(72) Inventors: Bryan C. Newberry, Tucson, AZ (US); Pascal B. Planchenault, Tucson, AZ (US)

(73) Assignee: Abrams Airborne Manufacturing, Inc., Tucson, AZ (US)

( * ) Notice: Subject to any disclaimer, the term of this patent is extended or adjusted under 35 U.S.C. 154(b) by 0 days.

(21) Appl. No.: 16/747,491

(22) Filed: Jan. 20, 2020

(65) Prior Publication Data

US 2020/0232733 A1 Jul. 23, 2020

Related U.S. Application Data

(60) Provisional application No. 62/794,894, filed on Jan. 21, 2019.

(51) Int. Cl.

| | |
|---|---|
| ***F41A 3/84*** | (2006.01) |
| ***F41A 3/82*** | (2006.01) |
| *F41C 23/04* | (2006.01) |
| *F41C 23/06* | (2006.01) |
| *F41A 3/66* | (2006.01) |

(52) U.S. Cl.

CPC ..... *F41A 3/82* (2013.01); *F41A 3/66* (2013.01); *F41C 23/04* (2013.01); *F41C 23/06* (2013.01)

(58) Field of Classification Search

CPC ..... F41A 3/78; F41A 3/84; F41A 3/80; F41A 3/82

USPC ..... 42/1.06; 89/198

See application file for complete search history.

(56) References Cited

U.S. PATENT DOCUMENTS

| | | | |
|---|---|---|---|
| 3,366,011 | A | 1/1968 | Sturtevant |
| 3,405,470 | A | 10/1968 | Wesemann |
| 5,909,002 | A | 6/1999 | Atchisson |
| 6,829,974 | B1 | 12/2004 | Gwinn, Jr. |
| 8,296,984 | B2 | 10/2012 | Kincel |
| 8,943,726 | B2 | 2/2015 | Kincel |
| 10,415,907 | B1 | 9/2019 | Kincel et al. |
| 2010/0251587 | A1 | 10/2010 | Kincel |

OTHER PUBLICATIONS

"KAK AR15 Configurable Buffer Kit", <URL: https://www.rainierarms.com/kak-ar15-configurable-buffer-kit/> ; [retrieved on Aug. 11, 2020].

*Primary Examiner* — Reginald S Tillman, Jr.
(74) *Attorney, Agent, or Firm* — Dugan Law Office, LLC

(57) ABSTRACT

A firearm buffer includes a buffer casing having a casing chamber with open and closed ends, and buffer weight within the casing chamber. A buffer plug is received in the open end of the buffer casing. A cross pin extends through at least a portion of the buffer plug retaining the buffer plug on the buffer casing. A locking pin is longitudinally displaceable between a first position and a second position. In the first position, the locking pin is engaged with the cross pin and retains the cross pin in position with respect to the buffer plug. In the second position, the locking pin is disengaged from the cross pin such that the cross pin is removable from engagement with the buffer plug thereby permitting disassembly of the firearm buffer. A method of assembling a firearm buffer is also included.

20 Claims, 18 Drawing Sheets

FIREARM BUFFERS AS WELL AS METHODS OF ASSEMBLING SAME

This application claims the benefit of priority to U.S. Provisional Patent Application Ser. No. 62/794,894, filed on Jan. 21, 2019, which is hereby incorporated herein by reference in its entirety.

BACKGROUND

The subject matter of the present disclosure broadly relates to the art of firearms and, more particularly, to firearm buffers, such as may be used in connection with an action of automatic and semi-automatic rifles and carbines, such as M16 and AR-15 series rifles and carbines, for example. Methods of assembling a firearm buffer are also included.

The subject matter of the present disclosure may find particular application and use in conjunction with automatic and semi-automatic rifles and carbines, such as the M16 and AR-15 series of rifles, for example, and will be shown and described herein with reference thereto. It is to be appreciated and understood, however, that the subject matter of the present disclosure is also amenable to use in connection with buffers for firearms of other types and kinds, and that the specific references shown and described herein are merely exemplary.

The original design for the M16/AR-15 series of rifles included a fixed buttstock and long barrel with the gas port located an appropriate distance from the breach. The original design also included an operating spring and buffer system that was cooperative with the length of the fixed buttstock and the performance requirements associated with the rifle barrel and gas porting arrangement.

As theater for conflicts and areas of use changed from more-open battlefields to urban areas, so too did the methods and tactics used by armed personnel. As a result, some firearms became shorter, more compact and easier to handle in confined spaces. In the case of the M16/AR-15 series of firearms, this was accomplished by shortening the barrel of the firearm and developing a telescoping stock system that allowed the user to adjust the length of pull. This telescoping stock system uses a shorter action spring than that of the rifle version with the fixed buttstock.

The shorter firearm is often referred to as a "carbine". As a result of shortening the barrel for the carbine, the location of the gas port was also moved closer to the breach and higher pressure gases are bled off at the gas port to provide energy for the firearm to operate than are bled off for the rifle version. In some cases, the gas pressures of the new shorter carbine firearm can be nearly double that of the original rifle version of the firearm. The significantly higher operating pressures would cause the carbine version to operate at much higher cyclic rates and with a noticeably increased bolt velocity. To counter this, the carbine action spring is stiffer than the rifle action spring, and the functional length of the carbine spring is much shorter than that of the rifle spring. As such, it has been recognized that the two weapons, the rifle and carbine, should utilize different combinations of stock tube, spring and buffer in order to operate properly.

Recently, automatic and semi-automatic rifles and carbines are being customized to include other, different barrel lengths and constructed with a variety of components and accessories that alter the performance and operation of the firearms. As such, firearm buffers having a variety of different weights and other performance characteristics have been developed. This provides firearm manufactures and users with the ability to select a firearm buffer that is complimentary to the performance characteristics of a specific firearm build. Unfortunately, this results in manufacturers and users inventorying numerous firearm buffers so that a firearm buffer having an appropriate weight and/or other performance characteristic is on hand and available as additional modifications are made to a given firearm.

Notwithstanding the overall success of known firearm buffer constructions, certain disadvantages still exist that remain to be addressed. Accordingly, it is believed desirable to develop modular firearm buffers and methods of assembly that overcome the foregoing and/or other problems and/or disadvantages of known designs, and/or otherwise advance the art of firearms.

INCORPORATION BY REFERENCE

U.S. Pat. No. 8,296,984 to Eric Stephen Kincel, which issued on Oct. 30, 2012 and is entitled SPRING ENHANCED BUFFER FOR A FIREARM, and U.S. Pat. No. 8,943,726, to Eric Stephen Kincel, which issued on Feb. 3, 2015 and is entitled SPRING ENHANCED BUFFER FOR A FIREARM, are each hereby incorporated herein by reference in their entirety.

BRIEF DESCRIPTION

One example of a firearm buffer in accordance with the subject matter of the present disclosure can include a buffer casing having a longitudinal axis. The buffer casing can include a casing wall extending peripherally about the longitudinal axis to at least partially define a casing chamber with a closed end and an open end. A buffer weight can be disposed within the casing chamber. A buffer plug can be at least partially received within the open end of the casing chamber. A cross pin can be disposed in a transverse orientation relative to the longitudinal axis and can extend through at least a portion of the buffer plug retaining the buffer plug on the buffer casing. A locking pin is longitudinally displaceable between a first position and a second position. In the first position, the locking pin is engaged with the cross pin and retains the cross pin in position with respect to the buffer plug. In the second position, the locking pin is disengaged from the cross pin such that the cross pin is displaceable in a transverse direction for removal from engagement with the buffer plug and thereby permitting disassembly of the firearm buffer.

One example of a method of assembling a firearm buffer in accordance with the subject matter of the present disclosure can include providing a buffer casing having a longitudinal axis. The buffer casing can include a casing wall extending peripherally about the longitudinal axis to at least partially define a casing chamber with a closed end and an open end. The method can also include providing a buffer weight and positioning the buffer weight within the casing chamber. The method can further include providing a buffer plug and positioning a portion of the buffer plug within the open end of the casing chamber. The method can also include providing a locking pin and positioning the locking pin at least partially within the casing chamber. The method can further include providing a cross pin and orienting the cross pin a direction transverse to the longitudinal axis. The method can also include positioning the cross pin through a portion of the buffer plug to thereby retain the buffer plug on the buffer casing. The method can also include engaging the locking pin with the cross pin to resist movement of the cross pin in a direction transverse to the longitudinal axis and thereby inhibit inadvertent disengagement of the cross pin from the buffer plug.

DETAILED DESCRIPTION

Turning now to the drawings, it is to be understood that the showings are for purposes of illustrating examples of the subject matter of the present disclosure and are not intended to be limiting. Additionally, it will be appreciated that the drawings are not to scale and that portions of certain features and/or elements may be exaggerated for purpose of clarity and ease of understanding.

Figure 1:
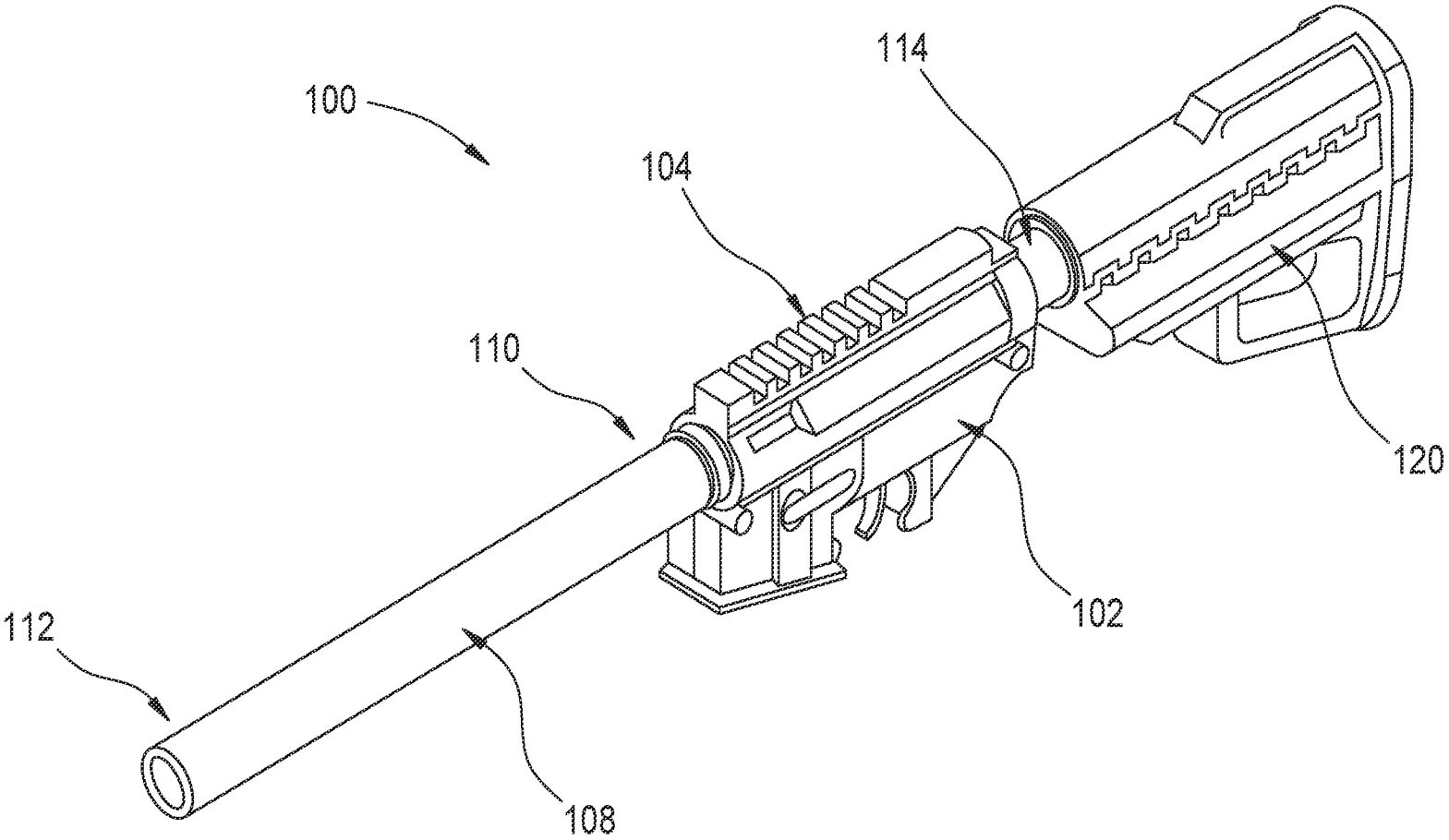
FIG. 1 is a top perspective view of an exemplary firearm including a buffer assembly in accordance with the subject matter of the present disclosure.
Figure 2:
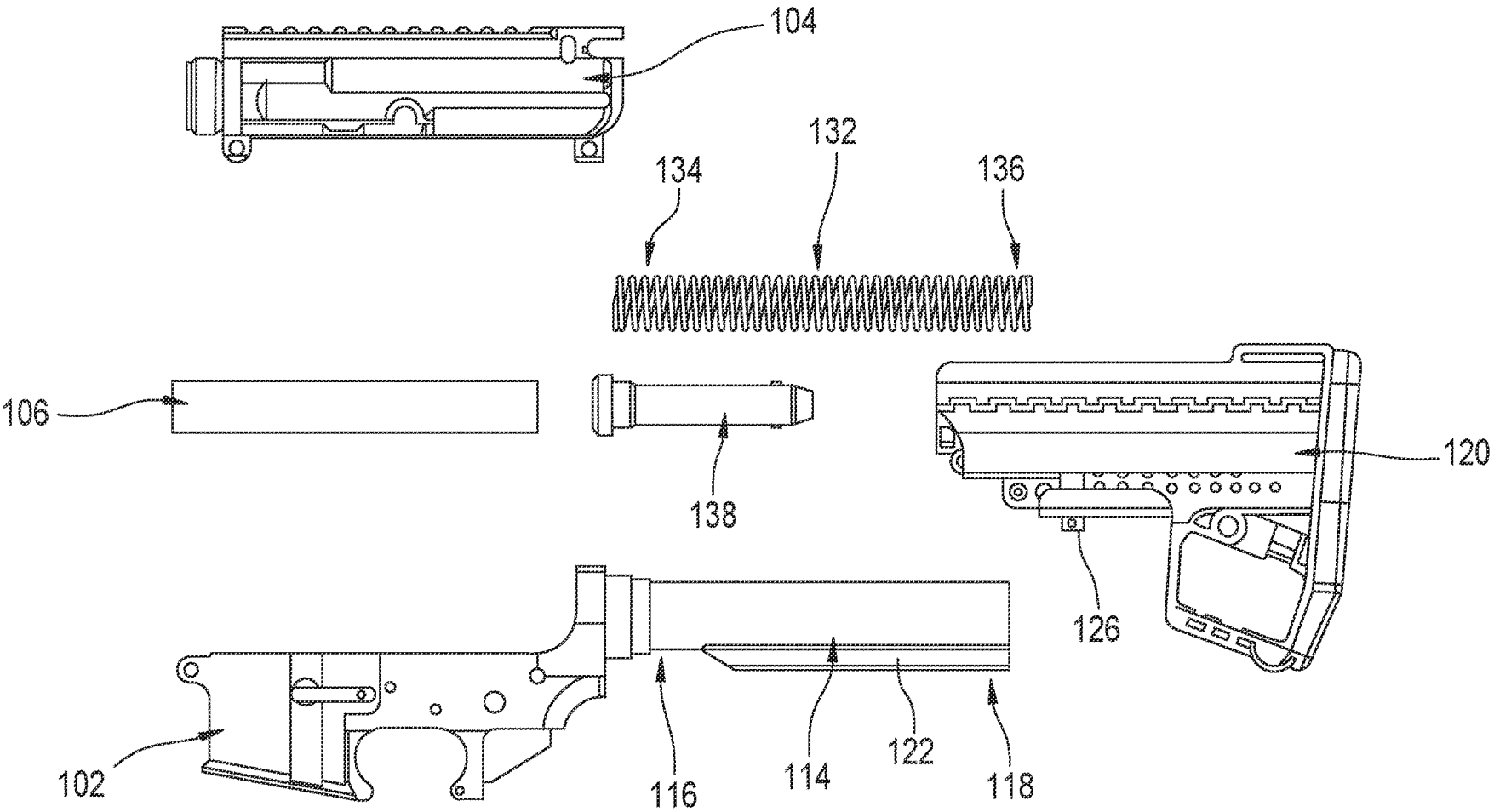
FIG. 2 is a side view of a buffer assembly in accordance with the subject matter of the present disclosure and additional components of the exemplary firearm in FIG. 1 prior to assembly.

FIG. 1 illustrates on example of a firearm 100 in accordance with the subject matter of the present disclosure. Firearm 100 can include a lower receiver 102 and an upper receiver 104 that form a frame on or along which other components of the firearm are mounted. For example, an action assembly, which is represented in FIG. 2 by box 106, is disposed between the upper and lower receivers in an assembled condition of the firearm. Action assembly 106 can include any one or more of a variety of components and elements that operate to cycle the firearm and discharge one or more bullets during use. On automatic and semi-automatic rifles and carbines, the action assembly will commonly load ammunition, lock the firing chamber, fire the ammunition as well as extract and eject the ammunition casing. As non-limiting examples, action assembly 106 can include any one or more of a bolt, a bolt carrier, a firing pin, and an extractor.

Firearm 100 also includes a barrel 108 that is secured to upper receiver 104 and is operatively associated with action assembly 106 such that bullets can be fired from a mounting end 110 of barrel 108 out a discharge end 112 of the barrel. A receiver extension 114 is secured to lower receiver 102 and extends longitudinally from a mounting end 116 in a direction away from barrel 108 toward a distal end 118 of the receiver extension. In some cases, a fixed buttstock can be mounted over the receiver extension. In other cases, however, the receiver extension can be adapted to accommodate a collapsible or multi-position buttstock. As shown in FIGS. 1 and 2, firearm 100 receiver extension 114 is of an appropriate length and configuration for use with a user-adjustable buttstock 120. Receiver extension 114 includes a lower rail 122 that include a plurality of adjustment recesses 124 into which an adjustment pin 126 of buttstock 120 can be received thereby allowing the user to adjust the length of pull of the firearm and/or otherwise alter the fit or function of the firearm.

Figure 3:
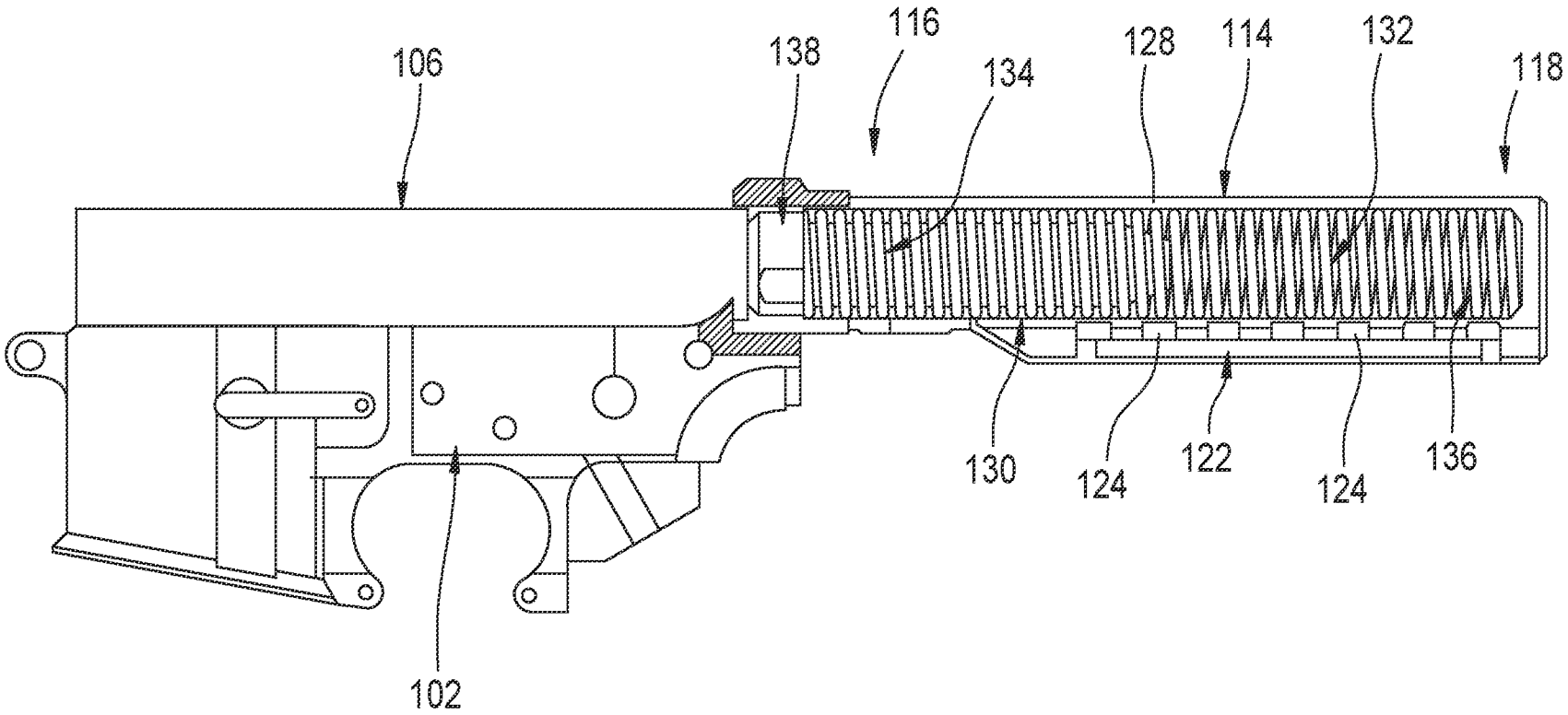
FIG. 3 is a side view, in partial cross section, of the buffer assembly and additional components of the exemplary firearm in FIGS. 1 and 2 shown partially assembled.
Figure 4:
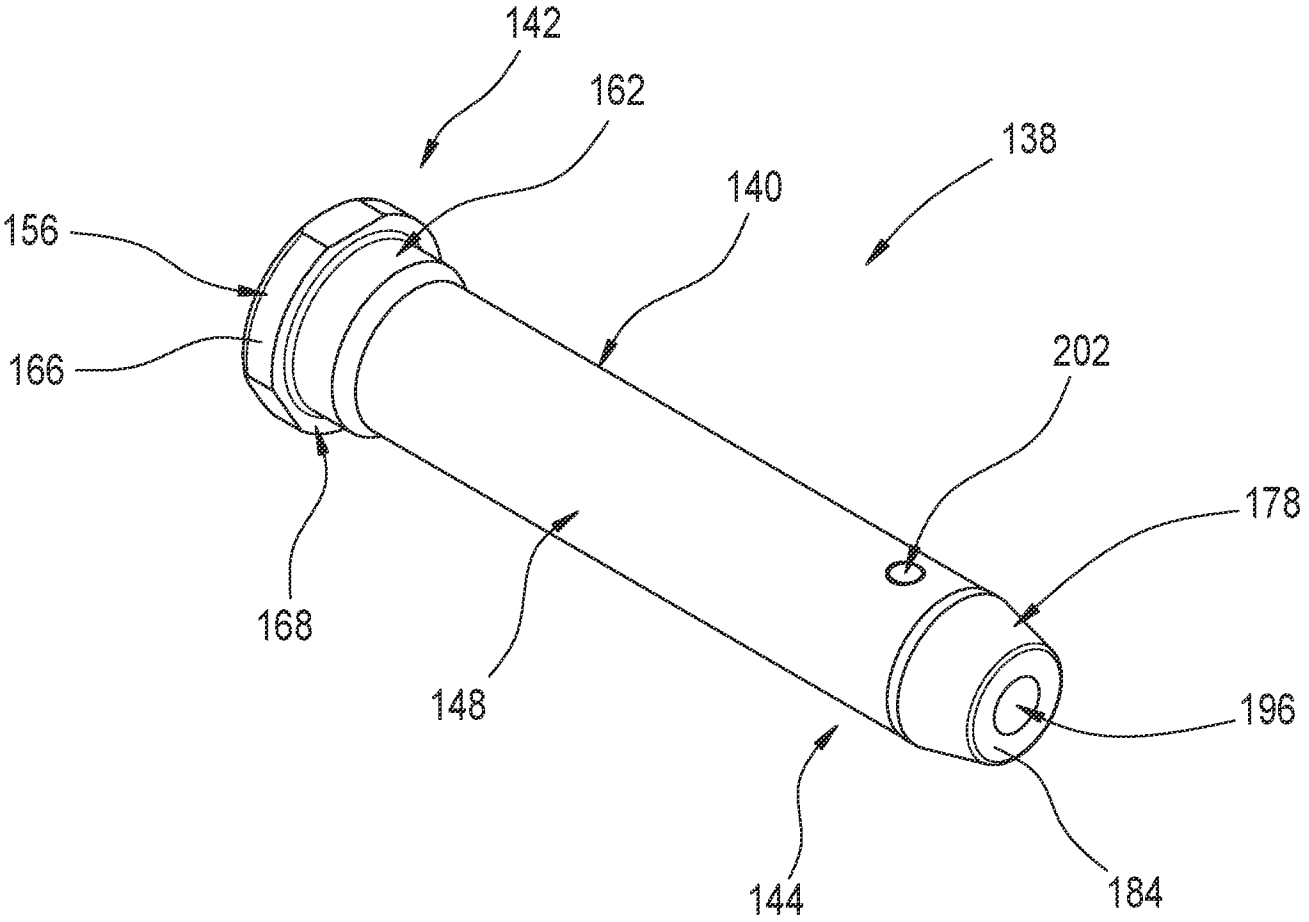
FIG. 4 is a top perspective view of a buffer assembly in accordance with the subject matter of the present disclosure, such as is shown in FIGS. 1-3.

Receiver extension 114 includes an extension wall 128 that at least partially defines a receiver extension chamber 130 that is typically open along mounting end 116 and closed along distal end 118. An action spring 132, which can alternately be referred to as a buffer spring or a recoil spring) extends between a proximal end 134 and a distal end 136, and is disposed within extension chamber 130 such that proximal end 134 is positioned toward action assembly 106 and distal end 136 of the action spring is positioned adjacent distal end 118 of receiver extension 114. A firearm buffer 138 in accordance with the subject matter of the present disclosure is typically disposed between action assembly 106 and proximal end 134 of action spring 132. In most cases, the action spring will take the form of an elongated coil spring that has an outer dimension sized to fit within the receiver extension chamber and an inner dimension sized to receive at least a portion of firearm buffer 138, such as is shown in FIG. 3, for example.

In an assembled condition, distal end 136 of action spring 132 abuttingly engages distal end 118 of receiver extension 114 and proximal end 134 of the action spring is seated on or along firearm buffer 138. Installed in such manner, action spring 132 is maintained in compression and urges firearm buffer 138 in a forward direction away from buttstock 120 and into abutting engagement with action assembly 106 or a component thereof (e.g., a bolt carrier). During use, action assembly 106 initiates the firing of a bullet from a cartridge of ammunition. Discharge gases force action assembly 106 and firearm buffer 138 rearward in a direction toward buttstock 120 compressing action spring 132 in the process. As the energy from the discharge gases that is acting on the action assembly is converted into mechanical potential energy through the compression of action spring 132, action assembly 106 and firearm buffer 138 will eventually discontinue movement in the rearward direction. Once stopped, the action assembly and firearm buffer will begin moving in a forward direction under the influence of action spring 132 as the action spring expands from a highly-compressed condition into a less compressed condition. Eventually, the action assembly and firearm buffer return to the initial firing position with the overall travel of the action and firearm buffer being referred to as a firing cycle.

It is well understood that firearms are designed to operate within a range of cycle rates. And, as discussed above, changing the components of a given firearm can generate a corresponding change in the cycle rate of that firearm. In some cases, the new cycle rate may be outside a desired range of operation. In such cases, increasing or decreasing the weight of the firearm buffer is a technique that can be used to adjust the cycle rate of the firearm back into the desired range of cycle rates at which the firearm operates. That is, it is well understood that increasing the weight of the firearm buffer can decrease the cycle rate of a firearm that is cycling faster than desired while decreasing the weight of the firearm buffer can increase the cycle rate of a firearm. As discussed above, however, firearm buffers are typically not constructed for disassembly and reassembly in the field or without special tools. As such, firearm manufacturers and owners often have an inventory of firearm buffers having different weights that can be installed in a given firearm to alter the performance characteristics and/or operation of the firearm as desired.

With reference, now, to FIGS. 4-13D, one example of a firearm buffer in accordance with the subject matter (e.g., firearm buffer 138) will be described. Firearm buffer 138 has a longitudinal axis AX (FIG. 5) and includes a buffer casing 140 that extends longitudinally between a closed end 142 and an open end 144. Buffer casing 140 includes a casing wall 146 with a side wall portion 148 that extends from along open end 144 toward closed end 142. Side wall portion 148 includes an outer surface portion 150 and an inner surface portion 152 that at least partially defines a casing chamber 154 within buffer casing 140. Casing wall 146 also includes an end wall portion 156 that at least partially forms closed end 142 of the buffer casing. End wall portion 156 can include inner and outer surface portion 158 and 160 oriented transverse to longitudinal axis AX and facing opposite one another with inner surface portion 158 at least partially defining the closed end of casing chamber 154. In some cases, casing wall 146 can, optionally, include a pilot wall portion 162 that is disposed longitudinally between side wall portion 148 and end wall portion 156. If included pilot wall portion 162 can include a pilot surface portion 164 disposed radially outward of outer surface portion 150 of side wall portion 148. End wall portion 156 includes an outer peripheral surface portion 166 that is disposed radially outward of side wall portion 148 and pilot wall portion 162, if included, to at least partially define a spring seat 168 therewith that extends annularly around the firearm buffer and is dimensioned to receive proximal end 134 of action spring 132. Buffer casing 140 can also include one or more holes or passage extending through casing wall 146 in a transverse direction relative to longitudinal axis AX. In the arrangement shown, buffer casing 140 includes two coaxial holes 170 and 172 that at least partially define a transverse casing axis TCX extending through buffer casing 140 and oriented transverse to longitudinal axis AX.

A firearm buffer in accordance with the subject matter of the present disclosure, such as firearm buffer 138, for example, can include any suitable number of one or more weights disposed within buffer casing 140. As a non-limiting example, a firearm buffer could include from 1 to 20 individual weights. In cases in which two or more buffer weights are used or otherwise included, it will be appreciated that the buffer weights can be at least partially formed from any combination of one or more materials. As a non-limiting example, two or more buffer weights could be formed from a common material. As another non-limiting example, one or more buffer weights could be formed from a first material having a first density and one or more other buffer weights could be formed from a second material having a second density that is different from the first density of the first material (e.g., steel and tungsten). In some cases, a firearm buffer kit (not numbered) can be provided that include one or more additional buffer weights, which can be of any combination of the first material, the second material and/or one or more third materials.

Additionally, a firearm buffer in accordance with the subject matter of the present disclosure, such as firearm buffer 138, for example, can include any suitable number of one or more cushions disposed within buffer casing 140. As a non-limiting example, a firearm buffer could include from 1 to 20 individual cushions and, in some cases, the number used can match or otherwise correspond to the number of weights that are included.

As shown in FIGS. 5 and 8-11, firearm buffer 138 includes buffer weights 174A-D as well as cushions or spacers 176A-D with buffer weight 174A disposed toward the closed end of buffer casing 140 and buffer weight 174B is disposed toward open end 144 of the buffer casing 140 with buffer weights 174C and 174D disposed therebetween. Cushion 176A is disposed between inner surface portion 158 of end wall portion 156 and buffer weight 174A with cushions 176B-D disposed between adjacent ones of buffer weights 174A-D. It will be appreciated, however, that other configurations and/or arrangements can be used without departing from the subject matter of the present disclosure. Additionally, as identified in FIG. 5, buffer weights 174E and 174F could be included as part of a firearm buffer kit in accordance with the subject matter of the present disclosure.

Firearm buffer 138 also includes a buffer plug or cap 178 that is supported on buffer casing 140 across open end 144 thereof. Buffer plug 178 includes a plug wall 180 that extends peripherally about longitudinal axis AX and extends longitudinally between end surface portions 182 and 184, which face opposite one another with end surface portion 182 facing toward buffer weight 174B and end surface portion 184 outwardly exposed along the firearm buffer. Buffer plug 178 also includes a side surface portion 186 that extends from along end surface portion 184 toward end surface portion 182 and is outwardly exposed in an assembled condition of firearm buffer 138. A side surface portion 188 extends from along end surface portion 182 toward end surface portion 184 and is disposed in facing relation to inner surface portion 152 of side wall portion 148 in an assembled condition of the firearm buffer. Side surface portion 188 is disposed radially inward of at least some of side surface portion 186 such that a shoulder surface portion 190 extends radially therebetween. In an assembled condition of the firearm buffer, shoulder surface portion 190 is disposed in facing relation to an end surface portion 192 of side wall portion 148 and can, in some cases, abuttingly engage the end surface portion of side wall portion 148.

Plug wall 180 of buffer plug 178 can also include an inner surface portion 194 that extends peripherally about longitudinal axis AX and at least partially forms a passage 196 that extends longitudinally through the buffer plug. Additionally, a surface portion 198 can at least partially define a passage 200 having a plug passage axis PPX that is oriented transverse to longitudinal axis AX with passage extending at least partially through plug wall 180 along side surface portion 188. In an assembled condition of firearm buffer 138, passage 200 can be disposed in approximate alignment with transverse casing axis TCX as well as one or more of holes 170 and/or 172 of buffer casing 140.

Firearm buffer 138 can further include a cross pin 202 that extends through at least a portion of buffer plug 178 and is operative to retain the buffer plug on or along open end 144 of buffer casing 140. Cross pin 202 includes a cross pin axis CPX and extends lengthwise between opposing end surface portions 204 and 206. Cross pin 202 includes a pin section 208 disposed toward end surface portion 204 that has an outer surface portion 210 extending from along end surface portion 204 toward end surface portion 206. Additionally, pin section 208 has an outer cross-sectional dimension OD1 across outer surface portion 210. Cross pin 202 also includes a pin section 212 disposed toward end surface portion 206 that has an outer surface portion 214 extending from along end surface portion 206 in an axial direction toward end surface portion 204. Additionally, pin section 212 has an outer cross-sectional dimension OD2 across outer surface portion 214.

Figure 12B:
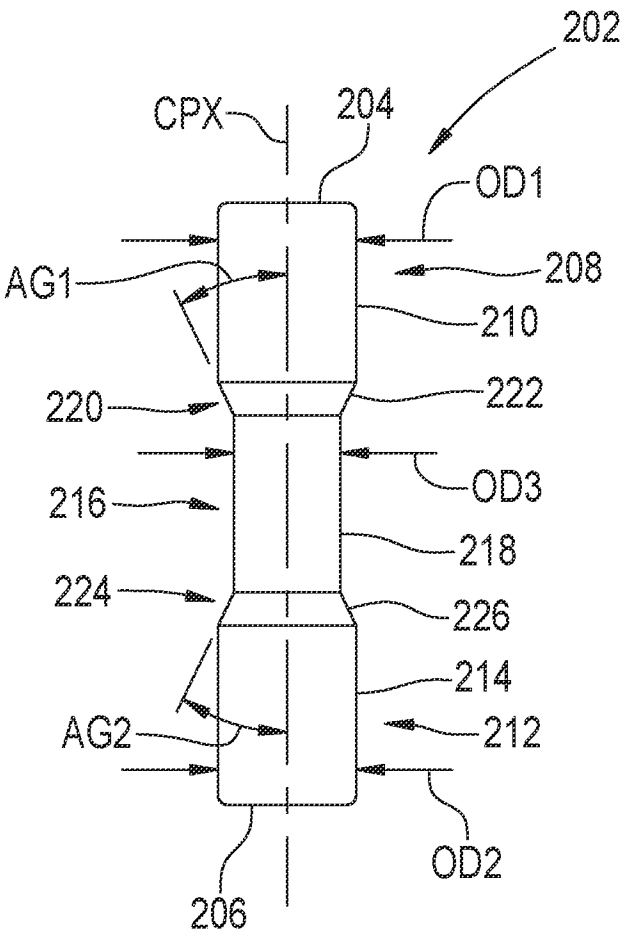
FIG. 12B is a side elevation view of the exemplary cross pin in FIG. 12A.
Figure 12A:
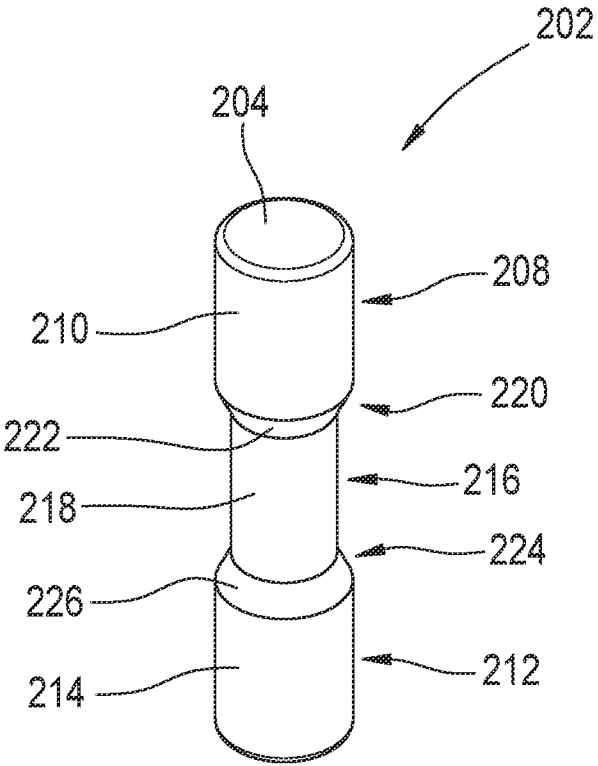
FIG. 12A is a top perspective view of one exemplary cross pin, such as is shown in FIGS. 4-11 and 8A-11A.

Cross pin 202 also includes a pin section 216 that is positioned between pin sections 208 and 212. Pin section 216 has an outer surface portion 218 with an outer cross-sectional dimension OD3. In the arrangement shown in FIGS. 5 and 8-12B, outer cross-sectional dimension OD3 is less than outer cross-sectional dimensions OD1 and OD2 such that outer surface portion 218 is disposed radially inward of outer surface portions 210 and 214. Cross pin 202 can also include a pin section 220 extending between pin section 208 and pin section 216. In such case, pin section 220 can include an outer surface portion 222 that transitions from outer surface portion 210 to outer surface portion 218. Additionally, or in the alternative, cross pin 202 can include a pin section 224 that extends between pin section 212 and pin section 216. If included, pin section 224 can include an outer surface portion 226 that transitions from outer surface portion 214 to outer surface portion 218. Outer surface portion 222 can have a cross-sectional profile or contour that extends from outer surface portion 218 toward outer surface portion 210 at an acute angle relative to cross pin axis CPX, as is indicated in FIG. 12B by angular dimension AG1. In a preferred arrangement, the cross-sectional profile or contour of outer surface portion 222 can be approximately linear such that pin section 220 has an approximately frustoconical shape. Additionally, or in the alternative, outer surface portion 226 can have a cross-sectional profile or contour that extends from outer surface portion 218 toward outer surface portion 214 at an acute angle relative to cross pin axis CPX, as is indicated in FIG. 12B by angular dimension AG2. Again, in a preferred arrangement, the cross-sectional profile or contour of outer surface portion 226 can be approximately linear such that pin section 224, if included, has an approximately frustoconical shape.

As discussed above, cross pin 202 extends through at least a portion of buffer plug 178 and is operative to retain the buffer plug on or along open end 144 of buffer casing 140. Additionally, cross pin 202 can extend through at least a portion of side wall portion 148 of casing wall 146, such as through either one or both of holes 170 and 172. In accordance with the subject matter of the present disclosure, cross pin 202 is capable of being removed and reinstalled with buffer casing 140 and buffer plug 178 in the field or otherwise without the use of special tools and without damage or destruction of a component of the firearm buffer. As such, it is desirable for cross pin 202 to have a free, clearance, running or sliding fit with the casing wall 146 and/or plug wall 180 such that the cross pin can be displaced through passage 200 as well as hole 170 and/or 172.

Figure 5:
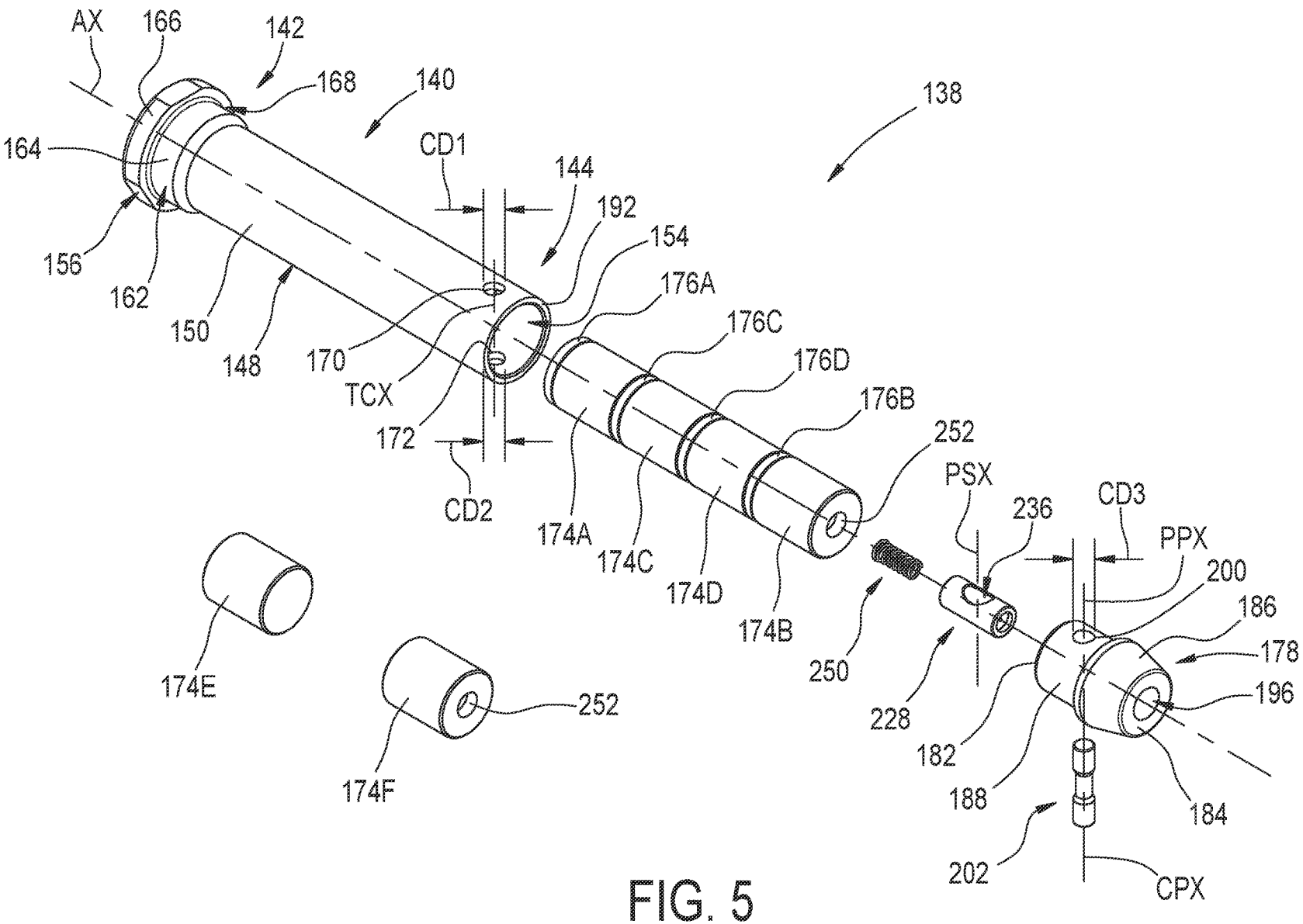
FIG. 5 is an exploded view of the buffer assembly in FIG. 4 shown together with additional components forming a firearm buffer kit.
Figure 6:
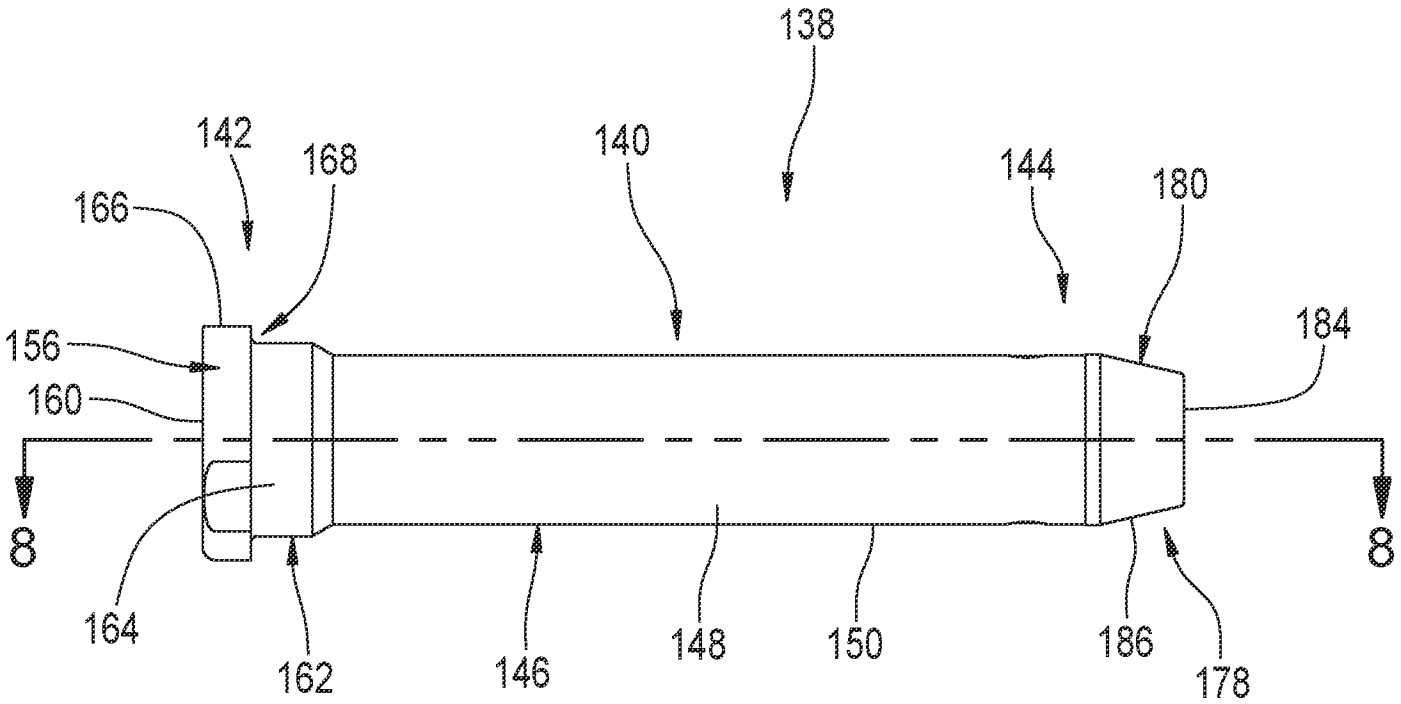
FIG. 6 is a side elevation view of the buffer assembly in FIGS. 4 and 5.
Figure 7:
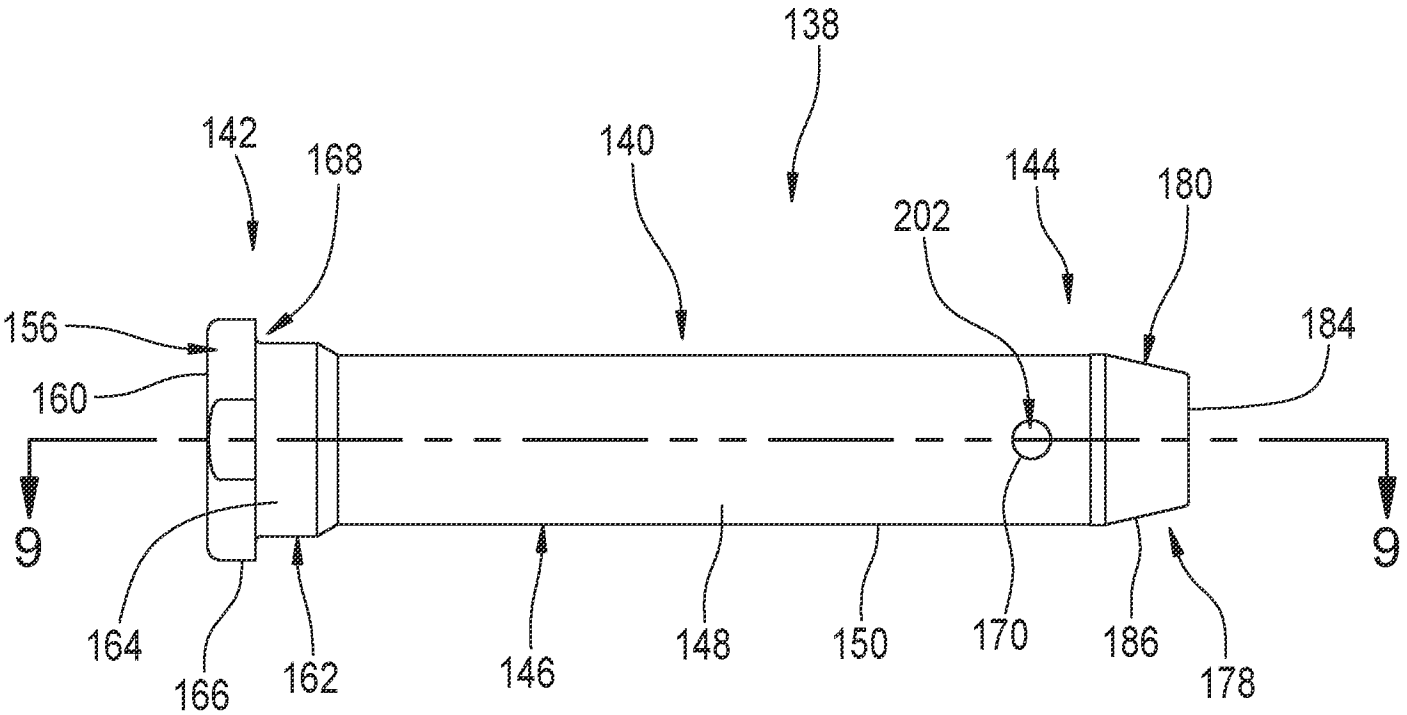
FIG. 7 is a top plan view of the buffer assembly in FIGS. 4-6.
Figure 8:
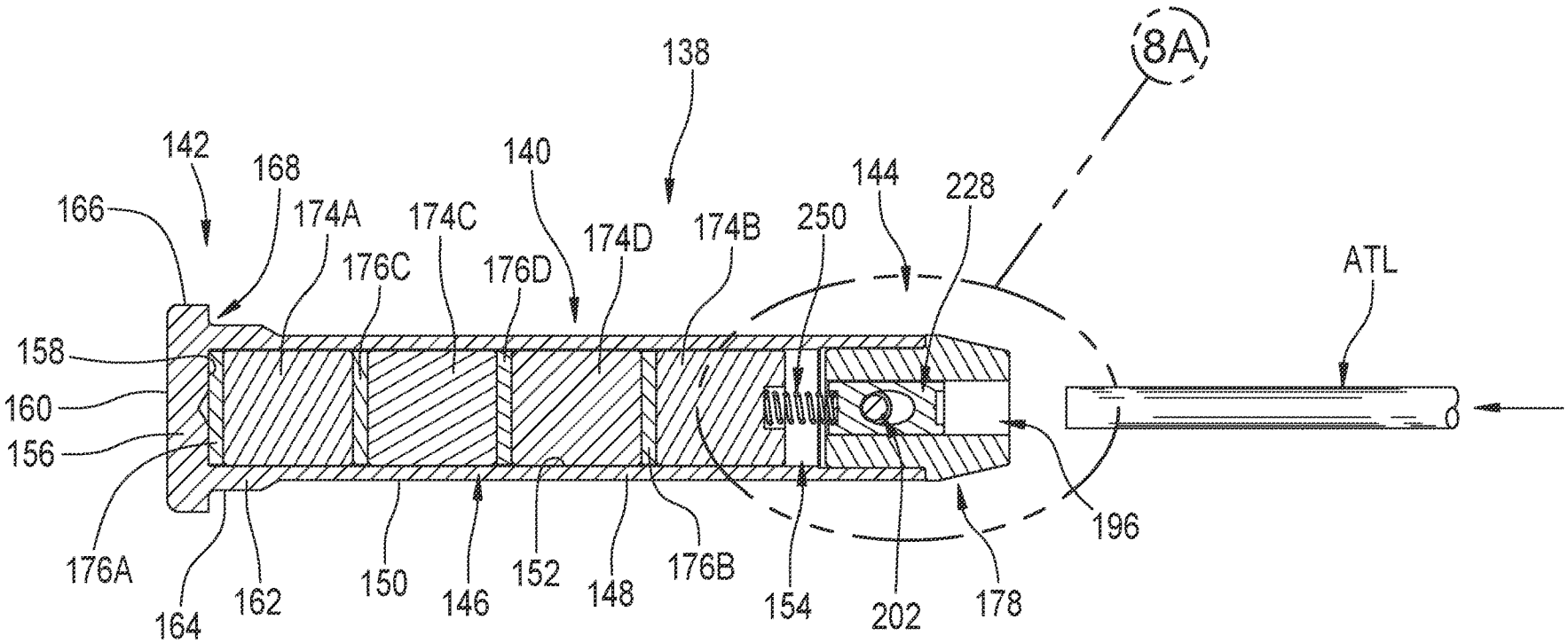
FIG. 8 is a cross-sectional view of the buffer assembly in FIGS. 4-7 taken from along line 8-8 in FIG. 6 with the buffer assembly shown in an assembled condition.
Figure 8A:
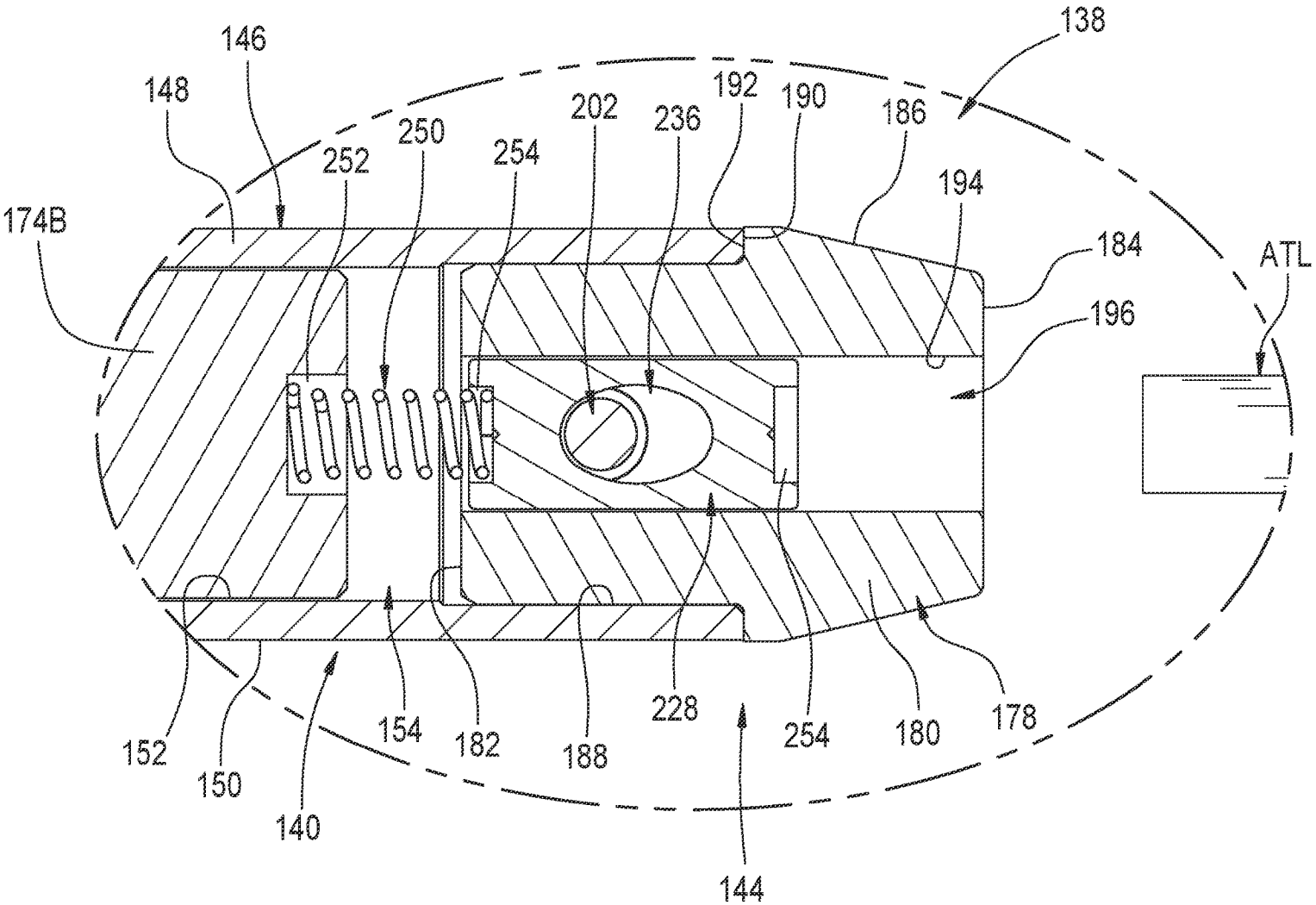
FIG. 8A is an enlarged view of the portion of the buffer assembly identified as Detail 8A in FIG. 8.
Figure 9:
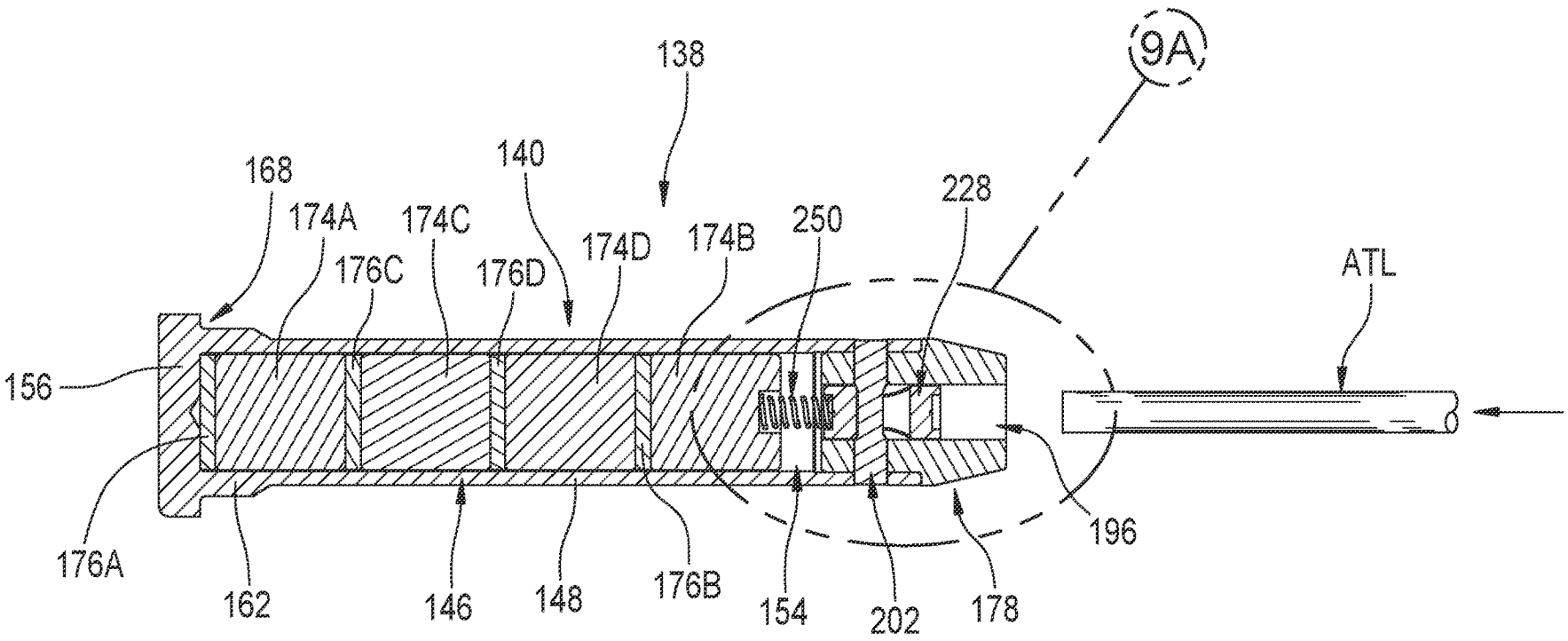
FIG. 9 is a cross-sectional view of the buffer assembly in FIGS. 4-8 and 8A taken from along line 9-9 in FIG. 7 with the buffer assembly shown in an assembled condition.
Figure 9A:
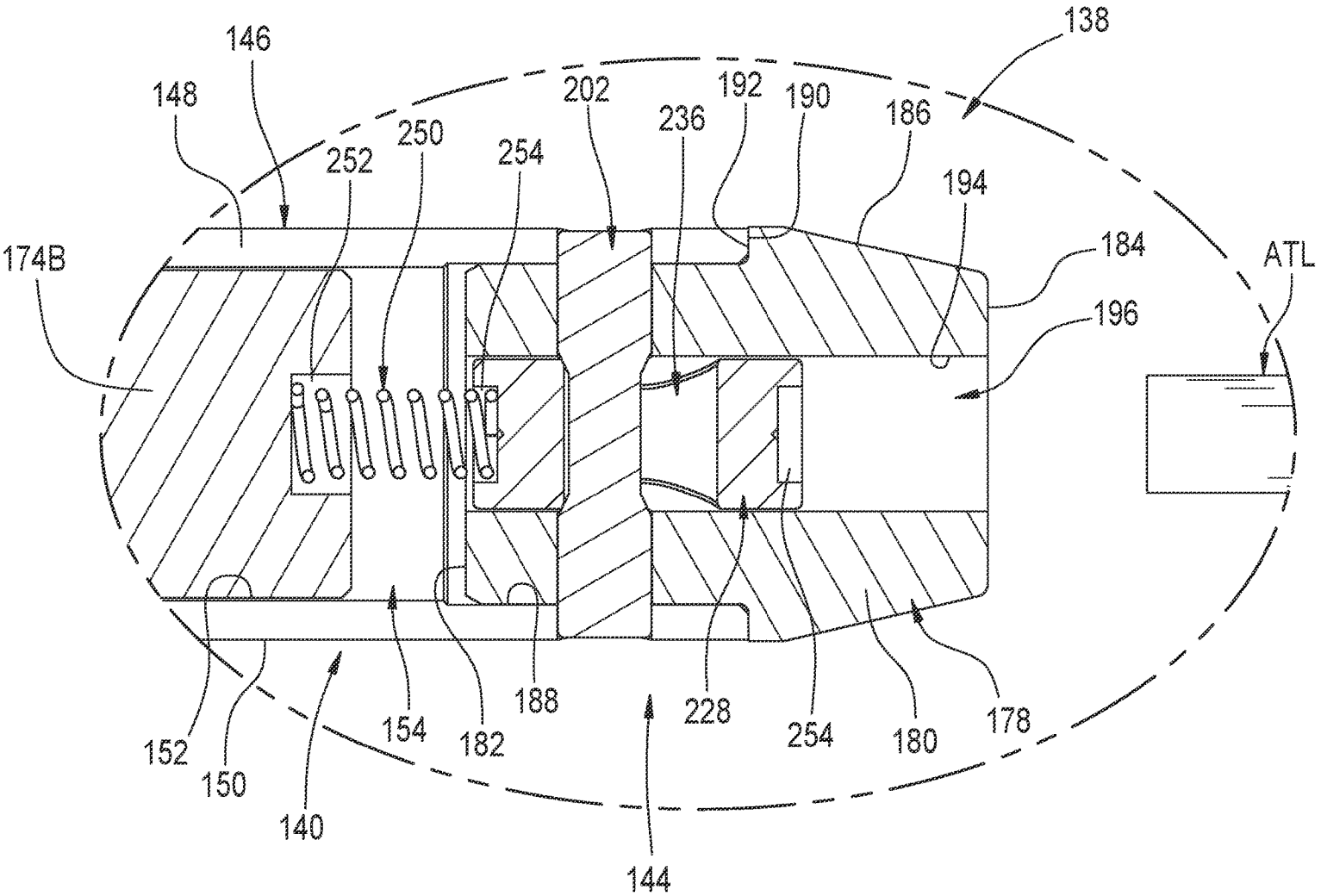
FIG. 9A is an enlarged view of the portion of the buffer assembly identified as Detail 9A in FIG. 9.
Figure 10:
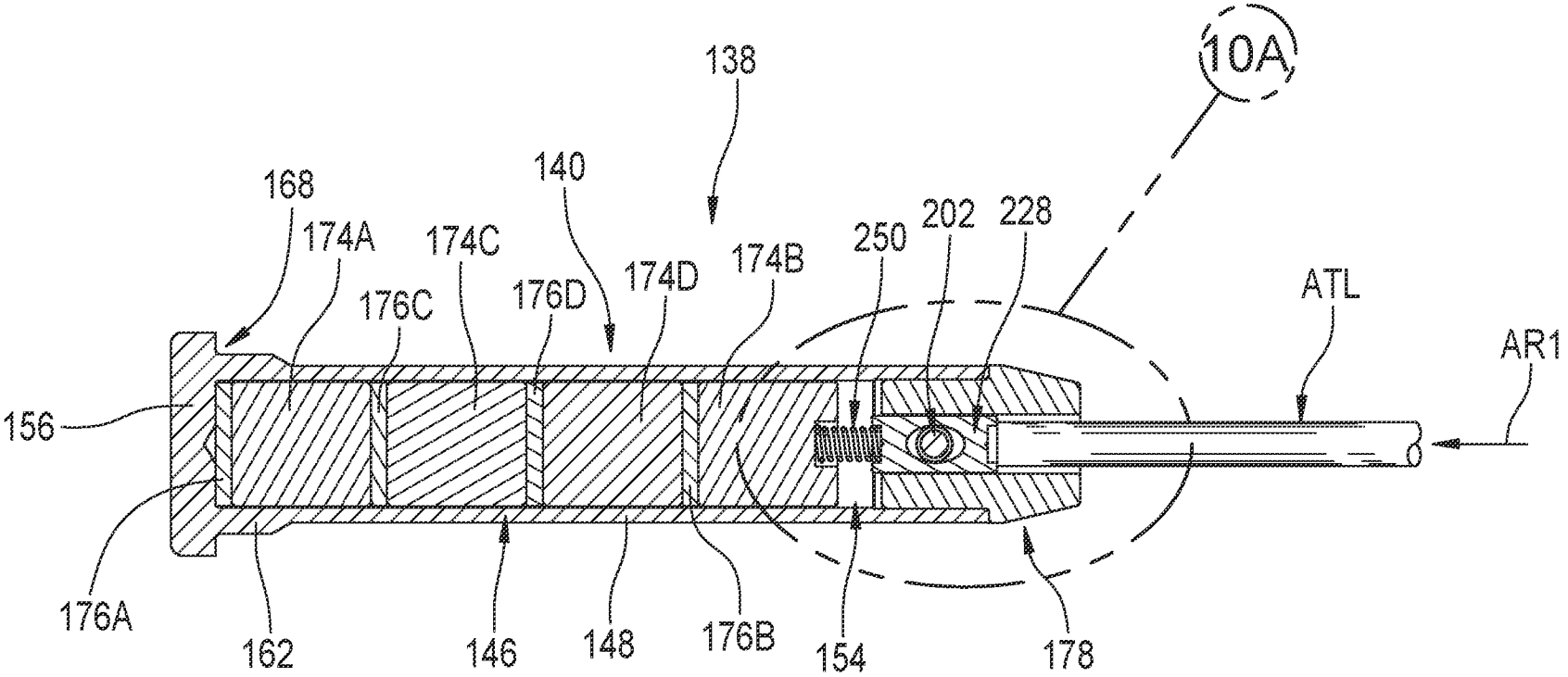
FIGS. 10 and 10A are views of the buffer assembly in FIGS. 8 and 8A with the buffer assembly shown in condition for disassembly.
Figure 10A:
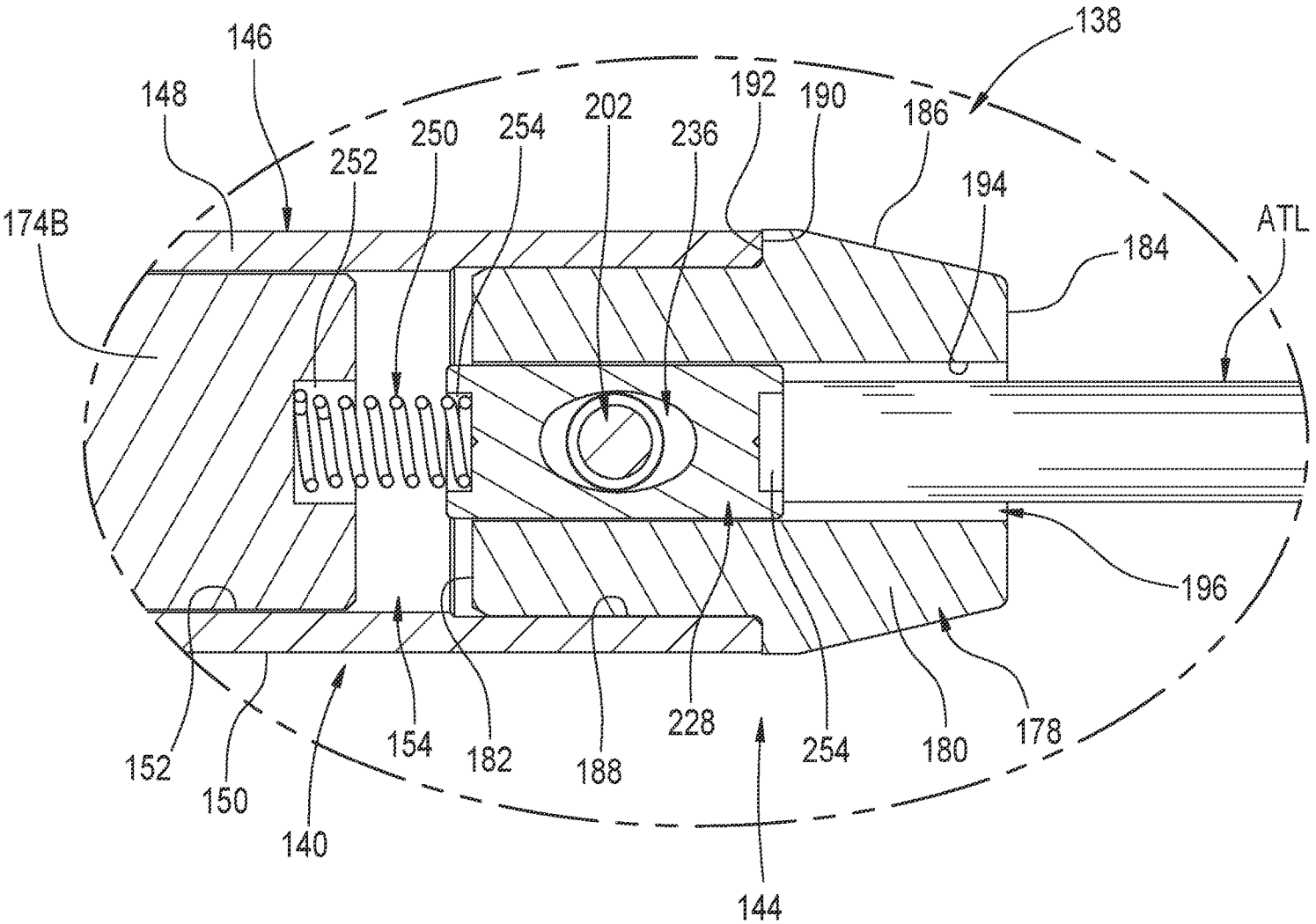
Figure 11:
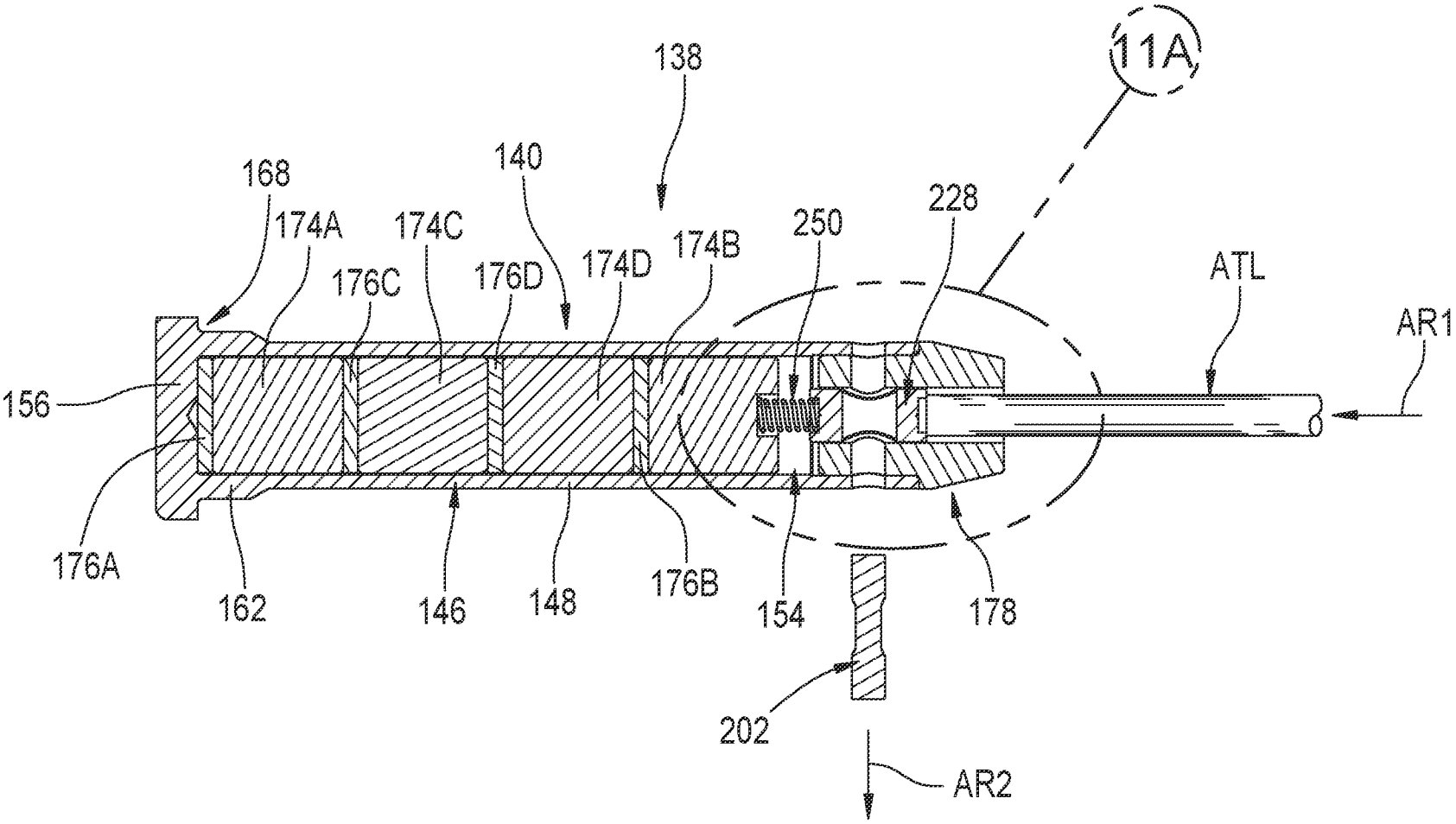
FIGS. 11 and 11A are the views of the buffer assembly in FIGS. 9 and 9A with the buffer assembly shown in condition for disassembly.
Figure 11A:
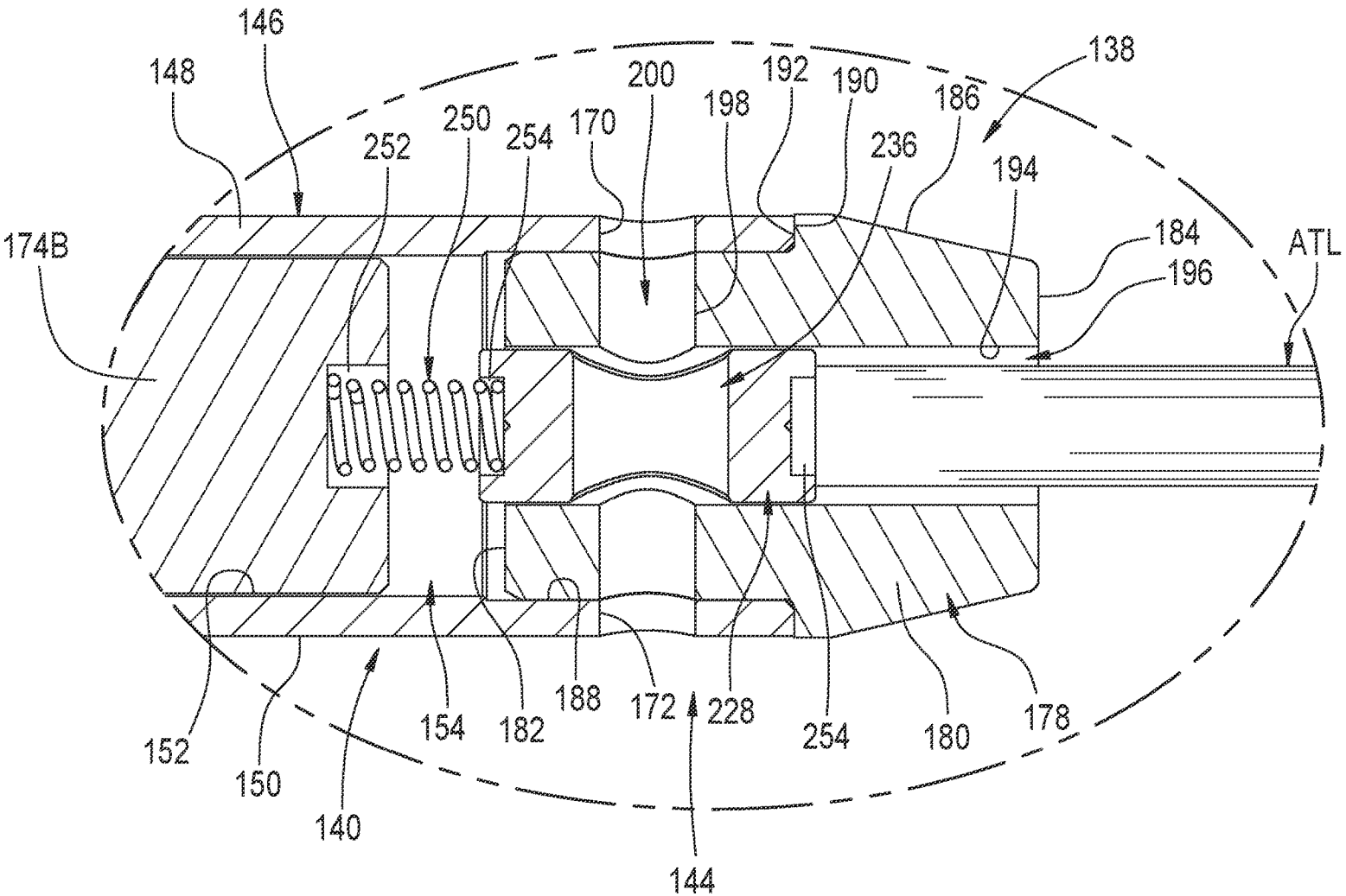

As identified in FIG. 5, holes 170 and 172 can have corresponding cross-sectional dimensions CD1 and CD2 with passage 200 having a cross-sectional dimension CD3. Cross-sectional dimension CD1 and cross-sectional dimension CD3 are greater than at least one of outer cross-sectional dimensions OD1 and OD2 so that cross pin 202 can be moved into and out of at least hole 170 and passage 200 in at least one direction when transverse casing axis TCX and plug passage axis PPX are at least approximately aligned and/or coaxial with one another. In some cases, the outer cross-sectional dimensions of the cross pin could be different from one another such that the cross pin can be moved into and out of passage 200 and one or both of holes 170 and 172 in only one direction. In other cases, cross-sectional dimensions CD1 and CD2 can be approximately equal to one another and greater than both outer cross-sectional dimensions OD1 and OD2 with cross-sectional dimension CD3 also being greater than the outer cross-sectional dimensions. In which case, cross pin 202 can be move into and out of engagement with casing wall 146 and plug wall 180 in both axial directions.

Firearm buffer 138 can also include a locking pin 228 that operatively engages cross pin 202 and minimizes or at least partially inhibits the unintentional movement or removal of the cross pin from one or more of passage 200, hole 170 and/or hole 172. Locking pin 228 extends longitudinally between opposing end surface portions 230 and 232, and includes an outer side surface portion 234 extending between the end surface portions. Locking pin 228 includes a passage surface (not numbered) that at least partially defines a passage 236 with a passage axis PSX extending through the locking pin and oriented transverse to longitudinal axis AX.

It will be appreciated that locking pin 228 can operatively engage cross pin 202 in any manner suitable for minimizing or at least partially impeding unintentional movement or removal of the cross pin from engagement with buffer plug 178 and/or buffer casing 140. As one example, passage 236 can take the form of an elongated, elliptical, ovoid or otherwise non-circular shape with the passage surface defining two or more zones or areas with at least one area dimensioned to permit cross pin 202 to freely pass through the locking pin and one or more other areas dimensioned to abuttingly engage the cross pin and minimize or inhibit movement of the cross pin along cross pin axis CPX relative to locking pin 228. As identified in FIG. 13B, locking pin 228 can include one or more passage surface portions 238 that at least partially define a passage area 240 that has a cross-sectional dimension CD4 that is greater than outer cross-sectional dimensions OD1 and OD1 of cross pin 202. As such, cross pin 202 can pass freely through passage 236 when locking pin 228 is positioned such that the cross pin is centered along or otherwise disposed within passage area 240. Additionally, locking pin 228 can include one or more passage surface portions 242 that at least partially define a passage area 244 that has a cross-sectional dimension CD5 that is less than outer cross-sectional dimensions OD1 and OD2 of cross pin 202. As such, locking pin 228 abuttingly engages cross pin 202 and thereby prevents or minimizes movement of the cross pin along cross pin axis CPX when locking pin 228 is positioned such that the cross pin is centered along or otherwise disposed within passage area 244.

Figure 13B:
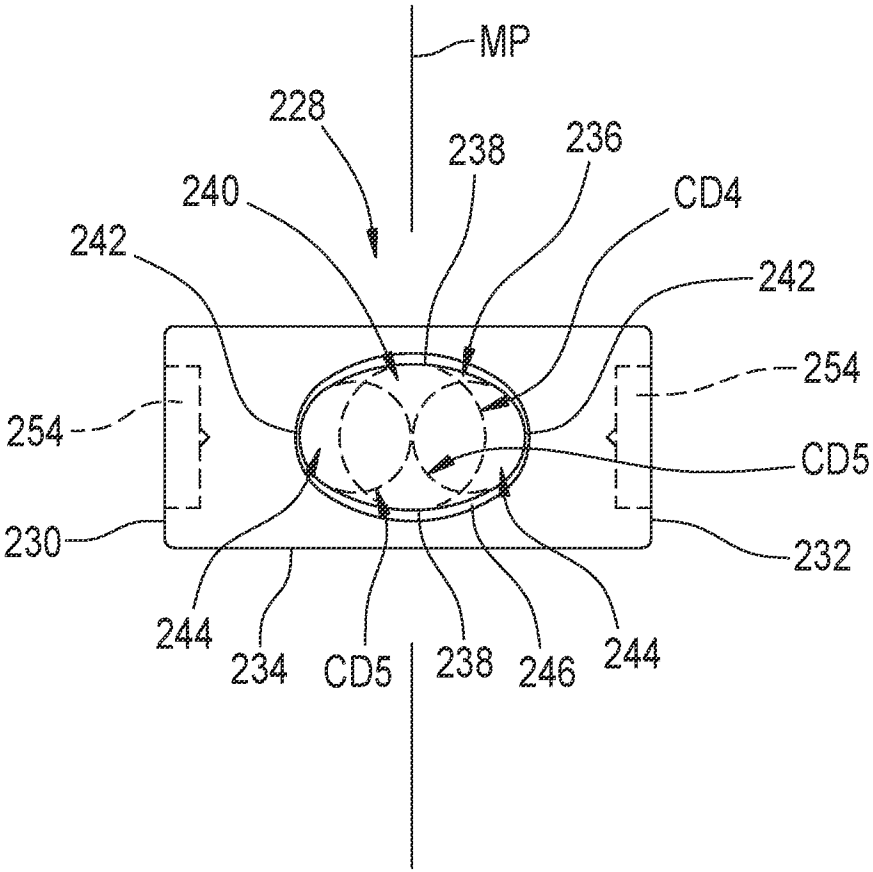
FIG. 13B is a top plan view of the exemplary locking pin in FIG. 13A.
Figure 13A:
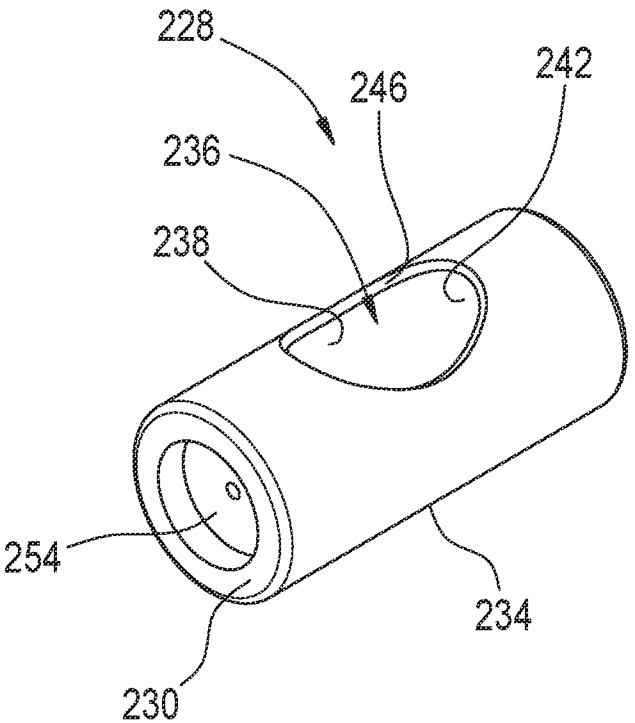
FIG. 13A is a top perspective view of one exemplary locking pin, such as is shown in FIGS. 4-11 and 8A-11A.
Figure 13D:
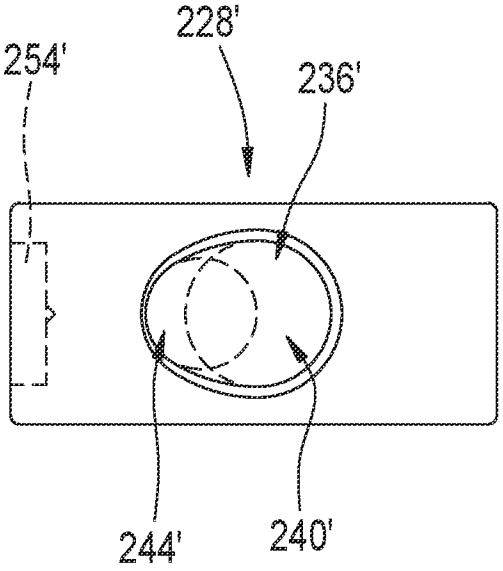
FIG. 13D is a top plan view of an alternate construction of the exemplary locking pin in FIGS. 13A-C.

In some cases, passage 236 can have a symmetrical configuration. In other cases, the passage can have an asymmetrical configuration. As shown in FIG. 13B, locking pin 228 has a midplane MP and passage 236 has a symmetrical configuration with respect to the midplane that includes a passage area 240 with passage areas 244 disposed on opposite sides of passage area 240. Such a construction allows locking pin 228 to be assembled into firearm buffer 200 in either direction. An alternate construction is shown in FIG. 13D in which locking pin 228' has a passage area 240' and a passage area 244', such as have been described above in connection with passage areas 240 and 244, respectively. Locking pin 228' differs from locking pin 228 in that only one of passage area 244' is included resulting in passage 236' having an asymmetric configuration.

Whether a symmetric or asymmetric configuration for passage 236/236' is used, locking pin 228 can also include an edge surface portion 246 disposed along one interface between outer side surface portion 234 and the passage surface (and surface portions thereof) that defines passage 236/236'. Additionally, or in the alternative, locking pin 228 can include an edge surface portion 248 disposed along the other interface between outer side surface portion 234 and the passage surface (and surface portions thereof) that defines passage 236/236'.

Figure 13C:
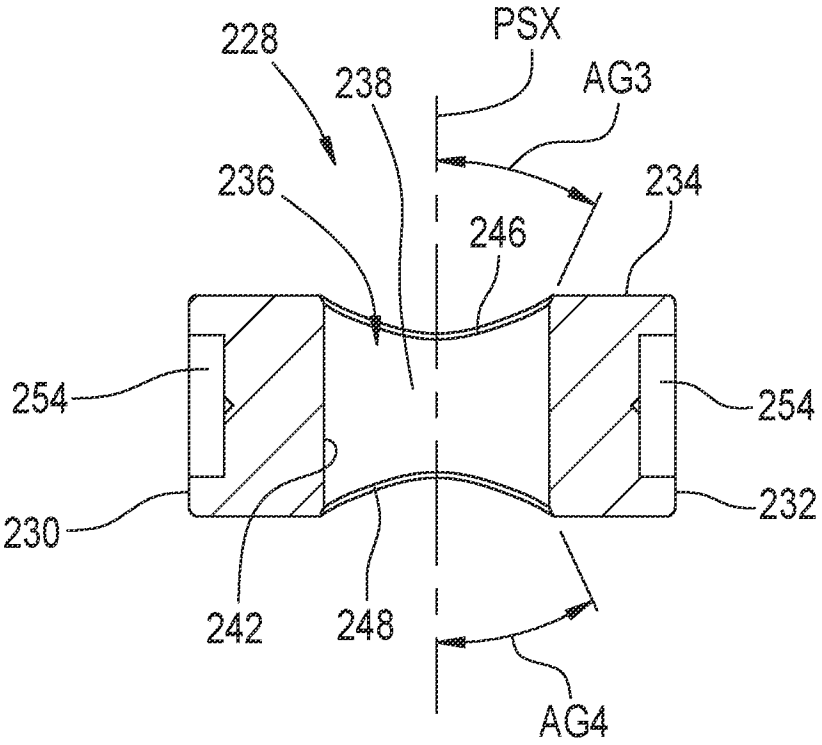
FIG. 13C is a cross-sectional side view of the exemplary locking pin in FIGS. 13A and 13B taken from along line 130-130 in FIG. 13B.

Edge surface portion 246 can have a cross-sectional profile or contour that extends from outer side surface portion 234 toward the passage surface or a portion thereof (e.g., passage surface portion 242) at an acute angle relative to passage axis PSX, as is indicated in FIG. 13C by angular dimension AG3. In a preferred arrangement, the cross-sectional profile or contour of edge surface portion 246 can be approximately linear. Additionally, or in the alternative, edge surface portion 248 can have a cross-sectional profile or contour that extends from outer side surface portion 234 toward the passage surface or a portion thereof (e.g., passage surface portion 242) at an acute angle relative to passage axis PSX, as is indicated in FIG. 13C by angular dimension AG4. In a preferred arrangement, the cross-sectional profile or contour of edge surface portion 248 can be approximately linear. In some cases, the cross-sectional profile or contour of edge surface portion 246 and/or edge surface portion 248 can be cooperative with the outer surface portions 222 and/or 226, respectively. In some cases, angular dimensions AG1 and AG3 can be approximately equal to one another and/or angular dimensions AG2 and AG4 can be approximately equal to one another. Additionally, or in the alternative, angular dimensions AG1 and AG2 can be approximately equal to one another and/or angular dimensions AG3 and AG4 can be approximately equal to one another. In cases in which cross pin 202 and locking pin 228 engage one another along both pin sections 220 and 224, the cross pin would be expected to have a self-centering functionality that will encourage cross pin 202 to remain engaged with buffer casing 140 and/or buffer plug 178.

Firearm buffer 138 can also include a biasing element 250 operatively connected with locking pin 228 and operable to urge the locking pin in a longitudinal direction away from closed end 142 of buffer casing 140. It will be appreciated that biasing element 250 is a structural component and that any suitable type, kind and/or number of biasing elements can be used, such as any combination of one or more coil springs, wave springs, conical disk springs and/or elastomeric polymer bodies, for example. In the arrangement shown and described herein, biasing element 250 is disposed in abutting engagement between buffer weight 174B and locking pin 228, and is operative to force or otherwise urge the locking pin into engagement with cross pin 202. It will be appreciated that the biasing element can be retained in position between the buffer weight and the locking pin in any suitable manner. As one non-limiting example, buffer weight 174B can include a recess 252 formed therein that is dimensioned to receive and retain one end of biasing element 250. Additionally, or in the alternative, locking pin 228 can include a recess 254 formed on or along end surface portion 230, end surface portion 232 or both end surface portions 230 and 232, such as is shown in FIGS. 13A-C, for example. In cases in which an asymmetric construction is used for the locking pin, a recess 254' can be formed along the end surface portion adjacent passage area 244' (i.e., end surface portion 230').

As discussed above, buffer assembly 138 is shown in an assembled condition in FIGS. 2-4, 6-9, 8A and 9A in which cross pin 202 is operatively engaged with buffer casing 140 and buffer cap 178 thereby retaining the buffer cap on or along the buffer casing. In such an arrangement, movement of cross pin 202 in a direction transverse to longitudinal axis AX is inhibited through the engagement of locking pin 228 with the cross pin. In accordance with the subject matter of the present disclosure, firearm buffer 138 can be disassembled and reassembled without the use of specialized tools or equipment. As such, a firearm buffer in accordance with the subject matter of the present disclosure can be easily reconfigured at home, at the range or in the field providing the user with the ability to alter the weight of the buffer assembly based on the desired performance characteristics of a given firearm.

As shown in FIGS. 8, 8A, 9 and 9A, locking pin 228 is in a position in which the locking pin is engaging cross pin 202 to retain the cross pin in position and maintain firearm buffer 138 in an assembled condition. To disassemble firearm buffer 138, an associated tool or implement ATL is extended into passage 196 to displace locking pin 228 from an engaged position to a disengaged position, such as are indicated by arrows AR1. That is, associated implement is moved into engagement with locking pin 228 and the locking pin is displaced toward closed end 142 of buffer casing 140 until cross pin 202 is moved out of alignment with passage area 244 and into alignment with passage area 240, such as is shown in FIGS. 10, 10A, 11 and 11A. Once passage area 240 is at least approximately aligned with cross pin 202, the cross pin can be easily removed from engagement with buffer casing 140 and buffer plug 178, such as is indicated by arrows AR2. Once cross pin 202 is removed, the associated implement can be disengaged from locking pin 228, and buffer plug 178, locking pin 228, biasing element 250 as well as one or more buffer weights 174A-D and/or one or more cushions 176A-D can be removed from open end 144 of buffer casing 140. The desired combination of one or more buffer weights 176A-F can be arranged with any one or more of the cushions, and firearm buffer 138 can be reassembled by reversing the process.

As used herein with reference to certain features, elements, components and/or structures, numerical ordinals (e.g., first, second, third, fourth, etc.) may be used to denote different singles of a plurality or otherwise identify certain features, elements, components and/or structures, and do not imply any order or sequence unless specifically defined by the claim language. Additionally, the terms "transverse," and the like, are to be broadly interpreted. As such, the terms "transverse," and the like, can include a wide range of relative angular orientations that include, but are not limited to, an approximately perpendicular angular orientation. Also, the terms "circumferential," "circumferentially," and the like, are to be broadly interpreted and can include, but are not limited to circular shapes and/or configurations. In this regard, the terms "circumferential," "circumferentially," and the like, can be synonymous with terms such as "peripheral," "peripherally," and the like.

It will be recognized that numerous different features and/or components are presented in the embodiments shown and described herein, and that no one embodiment may be specifically shown and described as including all such features and components. As such, it is to be understood that the subject matter of the present disclosure is intended to encompass any and all combinations of the different features and components that are shown and described herein, and, without limitation, that any suitable arrangement of features and components, in any combination, can be used. Thus it is to be distinctly understood claims directed to any such combination of features and/or components, whether or not specifically embodied herein, are intended to find support in the present disclosure. To aid the Patent Office and any readers of this application and any resulting patent in interpreting the claims appended hereto, Applicant does not intend any of the appended claims or any claim elements to invoke 35 U.S.C. 112(f) unless the words "means for" or "step for" are explicitly used in the particular claim.

Thus, while the subject matter of the present disclosure has been described with reference to the foregoing embodiments and considerable emphasis has been placed herein on the structures and structural interrelationships between the component parts of the embodiments disclosed, it will be appreciated that other embodiments can be made and that many changes can be made in the embodiments illustrated and described without departing from the principles hereof. Obviously, modifications and alterations will occur to others upon reading and understanding the preceding detailed description. Accordingly, it is to be distinctly understood that the foregoing descriptive matter is to be interpreted merely as illustrative of the subject matter of the present disclosure and not as a limitation. As such, it is intended that the subject matter of the present disclosure be construed as including all such modifications and alterations.

The invention claimed is:

1. A firearm buffer comprising:

a buffer casing having a longitudinal axis and including a casing wall extending peripherally about said longitudinal axis to at least partially define a casing chamber with a closed end and an open end spaced longitudinally from said closed end;

a buffer weight disposed within said casing chamber;

a buffer plug at least partially received within said open end of said casing chamber;

a cross pin disposed in a transverse orientation relative to said longitudinal axis and extending through at least a portion of said buffer plug and said casing wall such that said cross pin is operative to retain said buffer plug on said buffer casing; and, a locking pin longitudinally displaceable between a first position in which said locking pin is engaged with said cross pin and operative to retain said cross pin in position with respect to at least said buffer casing and a second position in which said locking pin is disengaged from said cross pin such that said cross pin is displaceable in a transverse direction for removal from engagement with at least said buffer plug and thereby permitting disassembly of said firearm buffer.

2. A firearm buffer according to claim 1 further comprising a biasing element urging said locking pin toward said first position.

3. A firearm buffer according to claim 2, wherein said biasing element is positioned between and abuttingly engages said locking pin and said buffer weight.

4. A firearm buffer according to claim 1, wherein said buffer plug includes a passage extending longitudinally therethrough such that said locking pin is abuttingly engageable therethrough.

5. A firearm buffer according to claim 1, wherein said engagement of said locking pin with said cross pin generates mutually opposing axial forces on said cross pin such that said cross pin is self-centering.

6. A firearm buffer according to claim 1, wherein said cross pin includes a first pin portion having a first cross-sectional dimension, a second pin portion having a second cross-sectional dimension and a third pin portion disposed between said first and second pin portions and having a third cross-sectional dimension that is less than said first and second cross-sectional dimensions.

7. A firearm buffer according to claim 6, wherein said first and second cross-sectional dimensions of said first and second pin portions are approximately equal.

8. A firearm buffer according to claim 6, wherein cross pin has a cross pin axis extending longitudinally therealong, and said cross pin includes a fourth pin portion extending between and interconnecting said first and third pin portions with said fourth pin portion having a first cross-sectional profile with at least a portion of said first cross-sectional profile oriented at a first acute angle relative to said cross pin axis.

9. A firearm buffer according to claim 6, wherein cross pin has a pin axis extending longitudinally therealong, and said cross pin includes a fifth pin portion extending between and interconnecting said second and third pin portions with said fifth pin portion having a second cross-sectional profile with at least a portion of said second cross-sectional profile oriented at a second acute angle relative to said pin axis.

10. A firearm buffer according to claim 6, wherein said locking pin has a locking pin axis extending longitudinally therealong, and said locking pin includes an outer surface portion extending peripherally about said locking pin axis.

11. A firearm buffer according to claim 10, wherein said locking pin includes a passage extending therethrough, said passage oriented transverse to said locking pin axis and at least partially defining a transverse passage axis.

12. A firearm buffer according to claim 11, wherein said passage is elongated in said longitudinal direction and has a substantially non-circular cross-sectional shape.

13. A firearm buffer according to claim 11, wherein said passage has a cross-sectional shape with a plurality of passage areas offset from one another in said longitudinal direction.

14. A firearm buffer according to claim 11, wherein said passage includes a first passage wall portion at least partially defining a first passage area having a first cross-sectional dimension and a second passage wall portion disposed in said longitudinal-spaced relation to said first passage wall portion and at least partially defining a second passage area, said second passage wall portion having a second cross-sectional dimension that is different than said first cross-sectional dimension.

15. A firearm buffer according to claim 14, wherein said cross pin has a major cross-sectional dimension and said first cross-sectional dimension of said passage is greater than said major cross-sectional dimension of said cross pin such that at least a portion of said cross pin can freely pass through said first passage area of said passage.

16. A firearm buffer according to claim 15, wherein said cross pin has a minor cross-sectional dimension and said second cross-sectional dimension of said second passage wall portion is greater than said minor cross-sectional dimension of said cross pin and less than said first cross-sectional dimension such that at least a portion of said locking pin can extend radially inward beyond said major cross-sectional dimension of said cross pin.

17. A firearm buffer according to claim 14, wherein said passage includes a third passage wall portion disposed in said longitudinal-spaced relation to said first passage wall portion in a direction opposite said second passage wall portion and at least partially defining a third passage area, said third passage wall portion having a third cross-sectional dimension that is different than said first cross-sectional dimension.

18. A firearm buffer according to claim 1, wherein said locking pin has a midplane oriented transverse to said longitudinal axis, and said locking pin is substantially symmetrical with respect to said midplane.

19. A firearm buffer according to claim 1, wherein said buffer weight is one of a plurality of buffer weights with a first buffer weight disposed toward said closed end of said casing chamber and a second buffer weight disposed toward said open end of said casing chamber.

20. A method of assembling a firearm buffer, said method comprising:

providing a buffer casing having a longitudinal axis and including a casing wall extending peripherally about said longitudinal axis to at least partially define a casing chamber with a closed end and an open end spaced longitudinally from said closed end;

providing a buffer weight and positioning said buffer weight within said casing chamber;

providing a buffer plug and positioning said buffer plug within said open end of said casing chamber;

providing a locking pin and positioning said locking pin at least partially within said casing chamber;

providing a cross pin and orienting said cross pin a direction transverse to said longitudinal axis;

positioning said cross pin through at least a portion of said buffer plug to thereby retain said buffer plug on said buffer casing; and, engaging said locking pin with said cross pin in a longitudinal direction to thereby resist movement of said cross pin in said direction transverse to said longitudinal axis and thereby inhibit inadvertent disengagement of said cross pin with said buffer plug.

* * * * *